US008269591B2

(12) United States Patent
Scherer et al.

(10) Patent No.: US 8,269,591 B2
(45) Date of Patent: Sep. 18, 2012

(54) ELECTRIC COIL

(75) Inventors: Clemens Scherer, Gilching (DE); Yvan Pillet, Bienne (CH); Guido Käufer, Deitigen (CH); Daniel Maeder, Grenchen (CH); Friedrich Durand, Rüttenen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 145 days.

(21) Appl. No.: 12/669,263

(22) PCT Filed: Jul. 15, 2008

(86) PCT No.: PCT/EP2008/059232

§ 371 (c)(1),
(2), (4) Date: Jun. 28, 2010

(87) PCT Pub. No.: WO2009/010508

PCT Pub. Date: Jan. 22, 2009

(65) Prior Publication Data

US 2010/0265021 A1 Oct. 21, 2010

(30) Foreign Application Priority Data

Jul. 18, 2007 (CH) ..... 1167/07

(51) Int. Cl.
*H01F 27/29* (2006.01)

(52) U.S. Cl. ..... 336/192

(58) Field of Classification Search ..... 336/200, 336/232, 223, 180–184, 192, 172–174, 212
See application file for complete search history.

(56) References Cited

U.S. PATENT DOCUMENTS

| | | | | |
|---|---|---|---|---|
| 4,728,916 | A * | 3/1988 | Fontecchio et al. | 335/255 |
| 4,759,120 | A | 7/1988 | Bernstein | |
| 2002/0101319 | A1 | 8/2002 | Komiya | |
| 2003/0067376 | A1* | 4/2003 | Maenosono | 336/174 |
| 2007/0063803 | A1* | 3/2007 | Yamashita et al. | 336/83 |
| 2009/0002112 | A1* | 1/2009 | Atsushi et al. | 336/83 |

FOREIGN PATENT DOCUMENTS

EP 1 489 635 A 12/2004

OTHER PUBLICATIONS

Search Report issued in the corresponding International application No. PCT/EP2008/059232, completed Oct. 22, 2008 and mailed Nov. 18, 2008.

* cited by examiner

*Primary Examiner* — Tuyen Nguyen
(74) *Attorney, Agent, or Firm* — Griffin & Szipl, P.C.

(57) ABSTRACT

An electric coil comprising a coil core (10), a main winding (16) surrounding the coil core (10) and having an electrically conductive coil wire, a start winding (14) surrounding the coil core (10) and having an electrically conductive coil wire, and an end winding (18) surrounding the coil core (10) and having an electrically conductive coil wire, is characterized in that the coil wire of the main winding (16), the coil wire of the start winding (14), and the coil wire of the end winding (18) are formed by a continuous wound wire, and at least the main winding (16), preferably also the start winding (14), is wound directly onto the coil core (10).

23 Claims, 2 Drawing Sheets

ELECTRIC COIL

This is a National Phase Application in the United States of International Patent Application PCT/EP2008/059232 filed Jul. 15, 2008, which claims priority on Swiss Patent Application No. 01167/07 of Jul. 18, 2007. The entire disclosures of the above patent applications are hereby incorporated by reference.

FIELD OF THE INVENTION

The invention relates to an electric coil according to the preamble of patent claim 1 and also to a method for contacting a coil, and to an arrangement comprising one coil and two contacts of an electrical supply line.

BACKGROUND OF THE INVENTION

Coils of this type are sufficiently known. In the case of these known coils, the individual windings, the start winding, the main winding and the end winding are wound onto a coil body separately from each other and the respective end portions of the individual windings are soldered or welded together. This mode of operation is very complex from a manufacturing point of view and, because of the soldering joints or welding joints, the entire coil arrangement contains potential sources of faults since, in this region, transition resistances or, in the course of the lifespan of such a coil arrangement, also interruptions in the current flow can occur, for example due to soldering joints which break because of mechanical vibrations. In addition, the windings must be placed in part above the soldering or welding joints.

It is the object of the present invention to configure a generic coil such that the production process is simplified and the susceptibility to defects in the finished product is reduced. In addition, the coil is intended to be able to be contacted as simply as possible. This has been difficult to date in particular if wires with a diameter of 50 μm or less are used since thin wires of this type can be contacted only with difficulty using conventional methods because of the lack of rigidity therein. Both the production of the coils and the contacting thereof are intended furthermore to be able to be achieved, even in large-scale production, simply, rapidly and above all without defects.

This object is achieved by the features indicated in the independent claims.

By providing a single winding wire for the main winding, the start winding and the end winding, no connection points occur between the respective windings, as a result of which both the manufacturing process is simplified and accelerated and the susceptibility to defects is reduced and hence the lifespan of the coil arrangement is increased.

Advantageous developments of the electric coil according to the invention are indicated in the sub-claims.

Preferably, at least the main winding, preferably also the start winding, is wound directly onto the coil core. In this embodiment, an additional coil body can be dispensed with so that the costs for production of a coil are reduced and also the constructional size of the coil in the radial direction is reduced. The coil body can in principle have any cross-section, there are possible in particular a rectangular or also a circular cross-section.

The coil core has thereby preferably been machined (barrel machined) with the help of a grinding process so that its surface is free of burrs and uneven regions.

Furthermore, it is advantageous if the coil core is provided at least in the region of the main winding with an insulating layer which is applied preferably on the coil core and if at least the main winding, preferably also the start winding, is wound onto the insulating layer. Provision of this insulating layer increases the reliability of the coil arrangement in that the risk of the insulation surrounding the winding wire rubbing on the coil core is reduced. The insulating layer applied directly on the coil core thereby assumes, in contrast to an additional coil body provided in the state of the art, a merely insignificant additional radial constructional space. The insulating layer can comprise suitable insulating tape which is wound around the coil body. However, in particular if the coils are manufactured on fairly large scales, this preferably concerns a polymer layer which is applied on the coil core with the help of a suitable coating method. A p-xylyene coating for example is particularly well suited, said coating having been produced by a chemical gas phase deposition. This type of coating is distinguished inter alia by its good electrical insulating properties even with very thin layers.

According to one embodiment of the invention, the end winding surrounds a portion of the main winding. The position of the end winding on the main winding can thereby be chosen without restriction so that any position of the end winding which is determined merely by the requirements of the intended application of the coil can be chosen. In addition, this arrangement makes possible a comparatively compact design.

According to an alternative embodiment, both the end- and the start winding is situated on the outside of the central main winding. This arrangement leads to an altogether flatter coil, which can be advantageous according to the constructional space present.

A further particularly advantageous embodiment of the invention is distinguished in that the respective number of turns of the coil wire of the start winding and of the end winding is calculated such that the respective electrical efficiency of the start winding and of the end winding is within prescribed tolerances after completion of the contacting with respective electrical supply lines. In this way, the electrical efficiency of the entire coil can be established precisely during manufacture and be retained within a prescribed tolerance range so that the manufacturing quality is substantially improved relative to conventional manufacturing methods.

The coil wire is coated, as normal, with a varnish, and in fact preferably with a so-called baked varnish, i.e. with an adhesive varnish, the adhesive effect of which is activated by heat. The present invention is suitable in particular for very small coils in which very thin wire is used, for example wire with a diameter in the range of less than 50 μm.

In the case of one method according to the invention for contacting a coil, in particular a coil according to the invention, a first contact of an electrical supply line, which is to be connected to the start winding, is connected to at least one external turn of the start winding in an electrically conductive manner, and a second contact of an electrical supply line, which is to be connected to the end winding, is connected to at least one external turn of the end winding in an electrically conductive manner.

The connection between the contacts of the electrical supply line and of the start- or the end winding is thereby produced according to the invention by welding or soldering, respectively a plurality of turns of the start- or of the end winding being able to be connected to the respective contacts of the electrical supply line in an electrically conductive manner. Preferably, a respectively suitable laser is thereby used for welding or soldering.

According to a particularly advantageous embodiment of the invention, the contacts of the electrical supply line have respectively one recess in an attachment region, firstly the attachment region being placed, during production of the connection, on the winding to be contacted such that this recess contacts the winding, and subsequently a laser beam being directed towards the attachment region in the region of the recess. This recess is preferably groove-shaped, a V- or U-shaped cross-section having proved to be particularly advantageous. The attachment region of the contact can be formed from a simple metal sheet, for example a copper sheet, which is provided with the V-shaped or a U-shaped profile in order to form the preferably groove-shaped recess. In this case, the connection can then be a welded connection since the copper sheet is connected directly to one or more coil wires. In order to achieve the required high temperature (here the melting temperature of copper), a laser with a correspondingly high energy density must be used.

Alternatively, the attachment region can be coated with a solder in the region of its recess also on the outside thereof, i.e. on the side which points in the direction of the coil, so that a soldered connection is produced with the help of the laser. Both a hard solder, such as for example the silver-phosphorus mixture which is marketed under the trade name Silfos, and a soft solder, such as for example tin, can thereby be used. In order to produce corresponding temperatures, lasers with a lower energy density suffice.

During the welding or soldering process, the metal sheet coated possibly with a solder is heated so that the varnish or baked varnish layer, with which the wires are coated, becomes plastic. The metal sheet drops with the preferably groove-shaped recess firstly between the turns of the winding to be contacted and displaces the plasticised baked varnish. A welded or soldered connection is produced between the attachment region of the contact, provided with a groove, and the wires of the uppermost turns of the winding to be contacted, via which the desired electrical connection is produced.

The quality of the welded or soldered connection between the wires of the coil and the contacts is determined primarily by the coupling of the laser beam into the material. In the case of non-uniform surface structures, a non-uniform and barely predictable coupling is obtained. As a result of the recess configured in the attachment region, a significant improvement is achieved here. The laser beam directed into the recess is reflected on the lateral walls thereof so that the energy is distributed uniformly in a precisely defined region. Particularly good contacting is thereby achieved with a groove-shaped recess. This can basically have any cross-section. A substantially V-shaped profile has proved to be particularly advantageous, a U-shaped cross-section is likewise conceivable.

According to a particularly preferred embodiment of the invention, the number of turns connected to the respective contact in an electrically conductive manner is chosen such that the electrical properties of the entire coil are within prescribed tolerances. For this purpose, an electrical variable, such as the resistance, of the coil can be measured, for example during the welding or soldering. When the desired value is reached, the laser beam is interrupted so that the joining process is interrupted. In this way, the coil can be manufactured such that the start winding and the end winding are negligible with respect to the overall electrical properties of the coil. The electrical properties of the coil are hence determined virtually exclusively by the main winding.

SUMMARY OF THE INVENTION

Preferably, in the method according to the invention, the first contact of the electrical supply line, which is to be connected to the start winding, is connected to at least one winding turn situated under the external turns of the start winding in an electrically conductive manner.

Furthermore, in the method according to the invention, preferably the second contact of the electrical supply, which is to be connected to the end winding, is connected to at least one turn situated under the external turns of the end winding in an electrically conductive manner.

The present invention also relates to an arrangement comprising one coil of the described type and two contacts of an electrical supply line, a first contact being connected to the start winding of the coil in an electrically conductive manner, and a second contact being connected to the end winding of the coil in an electrically conductive manner: both contacts respectively having a preferably groove-shaped recess in an attachment region and this recess sitting respectively between the external turns of the start- or end winding.

BRIEF DESCRIPTION OF THE DRAWINGS

The invention is explained subsequently in more detail by means of an example and with reference to the drawings. The Figures thereby show in detail.

DETAILED DESCRIPTION OF THE ILLUSTRATIVE EMBODIMENTS

Figure 1:
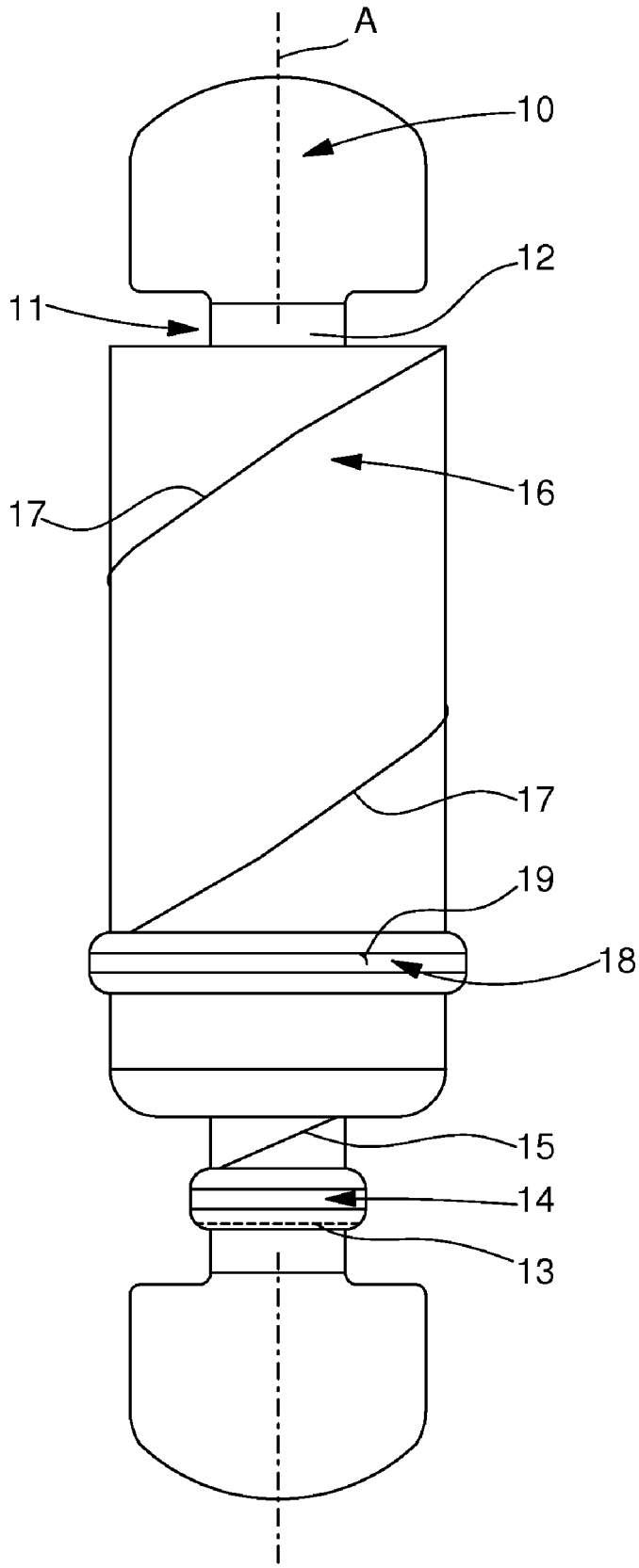
FIG. 1: a plan view on a coil according to the invention.

The coil 1 has a coil core 10 which preferably comprises a silicon-iron alloy (SiFe) or a nickel-iron alloy (NiFe). The surface of the coil core is treated with a grinding process (barrel machined) so that no burr residues or uneven regions remain. The coil core 10 is provided with a central coil portion 11 along the coil axis A. The central coil portion 11 is provided, on the circumference thereof, with an insulating layer 12 which is formed by electrically insulating adhesive tape which is glued onto the circumference of the central coil portion 11. Alternatively, the insulating layer 12 can also be applied in a different manner, for example by coating or varnishing the central coil portion 11, e.g. with a p-xylylene coating, as was already mentioned above. In the Figures, a coil core 10 with a rectangular cross-section is represented. A circular or oval cross-section is however likewise conceivable. Furthermore, the insulating layer 12 can also be omitted.

In the region of the first axial end of the central coil portion 11, a start winding 14 comprising a plurality of turns of an electrically conductive coil wire is wound onto the insulating layer 12 coaxially about the coil axis A. The first free end 13 of the coil wire, which is illustrated in the Figure in broken lines, is thereby situated on the radially inner circumference of the start winding 14. The other end of the start winding 14 is guided laterally out of the start winding 14 in the axial direction and forms a first connecting wire 15 between the start winding 14 and a main winding 16 which is at a spacing from the latter in the axial direction. The main winding 16 comprises a large number of turns of the coil wire, which are situated axially adjacently and radially one above the other, and is the same winding wire as the coil wire of the start winding 14. The coil wire is covered by a so-called baked varnish or adhesive varnish. The main winding 16 extends into the vicinity of the second end of the central coil portion 11 and is likewise wound onto the insulating layer 12 surrounding the central coil portion 11. The end of the main winding 16 is situated on the radially outer circumference of the main winding 16 and, as a second connecting wire 17, is guided there to a constructionally prescribed location on the outer circumference of the main winding 16, at which location the coil wire forms an end winding 18 which comprises a plurality of turns and surrounds the main winding 16. The second free end 19 of the winding wire, which forms the three coil wires and the two connecting wires, is consequently placed at the radial outer circumference of the end winding 18.

According to a variant which is not illustrated in the Figures, the end winding can also be disposed symmetrically relative to the start winding. In this case, it therefore surrounds not the main winding but is situated in the region of the second axial end of the central coil portion and hence axially next to the main winding. In both variants, the basic principle is the same since, also with this variant, only a single wire is used. Whatever arrangement of start-, main- and end winding is chosen, depends in particular upon the constructional space present and any possible specifications about the position of the contacts.

Figure 2:
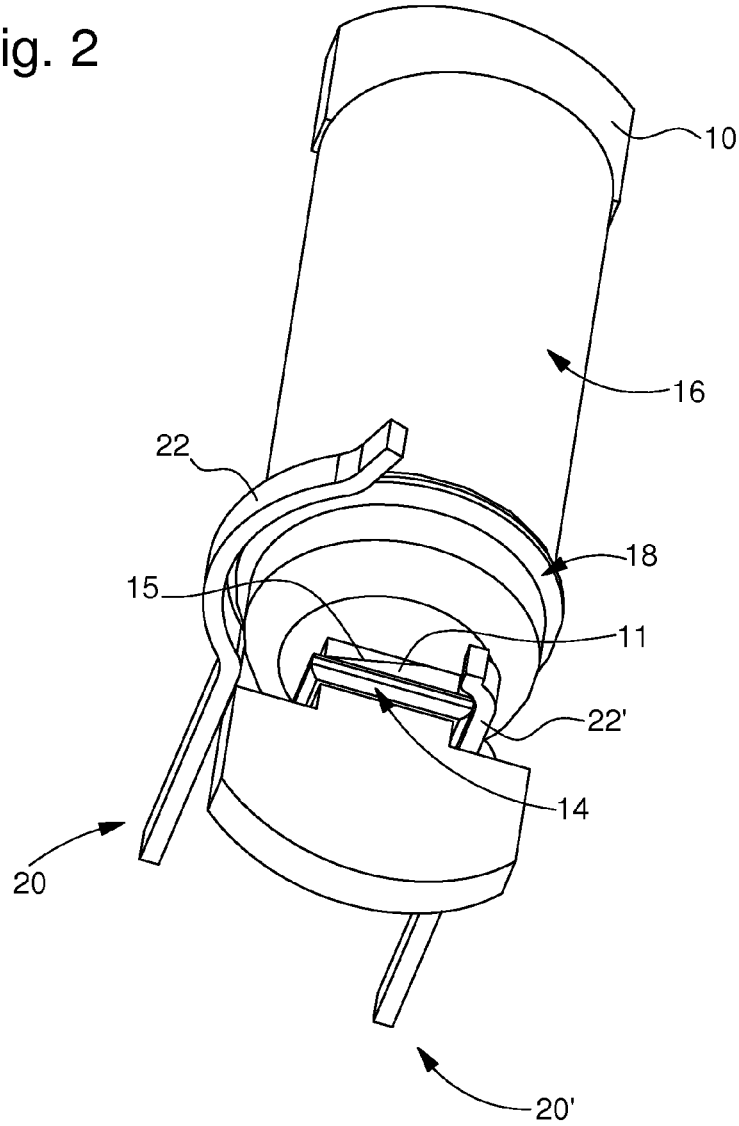
FIG. 2: a perspective illustration of an arrangement comprising one coil and two contacts of an electrical supply line.

After production of the coil, the start winding 14 and the end winding 19 respectively are connected to contacts 20, 20' of an electrical supply line, illustrated in FIG. 2, by welding or soldering in an electrically conductive manner.

As is seen in FIG. 2, the contacts 20, 20' respectively end in a greatly extended flexible tongue 22, 22' which comprises a thin copper sheet. The other end of the contacts 20, 20' is connected to electrical supply lines, not shown here. However, the tongues 22, 22', via which the contact with the coil according to the invention is produced, are primarily important for the present invention. These tongues 22, 22' are provided in an attachment region, which is represented enlarged and in section in FIG. 3, with a groove-shaped recess 24 which has a substantially V-shaped cross-section. This V-shaped groove extends in the longitudinal direction relative to the tongue 22 or 22' and hence parallel to the turns of the start- or end winding 14, 18 (cf. FIGS. 2 and 3). In the embodiment represented in the Figures, the groove-like recess 24 in the attachment region of the contacts has in fact a V-shaped cross-section, a U-shaped cross-section, any other groove shapes or a simple crater-like recess are however likewise conceivable.

The method for producing the connection between the start winding 14 or the end winding 18 and the respectively associated contact 20' 20 is described subsequently with reference to the end winding 18; however, it is applied analogously also for contacting the start winding.

Figure 3:
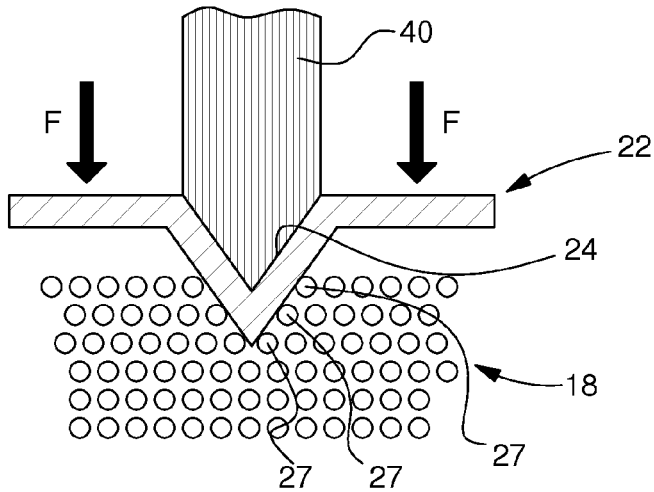
FIG. 3: a schematic representation of an attachment region of a contact during contacting of a coil.

Firstly, the attachment region of the tongue 22 of the contact 20, which has possibly already been heated in advance, is pressed radially onto the end winding 18, the groove-shaped recess 24 coming to be situated with its lowest point on the externally situated turns of the end winding 18. The radial contact pressure is indicated in FIG. 3 by arrows F. As represented in FIG. 3, a laser beam 40 is subsequently directed into the V-shaped recess. As a result, the thin copper sheet of the tongue 22 is heated in the region of the recess 24. As a result of the "bundling" of the laser beam through the lateral walls of the groove-shaped recess, uniform heating and uniform and predictable coupling of the laser beam 40 are obtained. Because of the heat impingement, the baked varnish covering softens around the wires of those turns 27 which are situated directly below the attachment region of the contact 20. The attachment region hence penetrates, as a result of the effect of contact pressure and laser beam 40, with the V-shaped tip firstly between the turns, the plasticised baked varnish being displaced. Uncontrolled baking of the wires to each other is avoided and, as a result of the plasticised and displaced baked varnish covering, the desired insulation of the contacted wire is obtained.

A soldered connection can also be produced with the portrayed method, then the outside of the tongue 22 pointing in the direction of the coil being coated beforehand with a solder. This solder becomes soft as a result of the heat produced by the laser beam 40 and is connected to the wires of the winding to be contacted in principle in precisely the same way as portrayed above for the uncoated tongue 22.

According to the strength of the contact pressure and according to how long the laser beam 40 is directed into the V-shaped recess 24 of the tongue 22, more or fewer turns 27 are thereby contacted electrically. The mentioned factors can thereby be adjusted such that precisely as many turns are contacted as is required in order to keep the electrical properties of the coil (e.g. the impedence or the overall electrical resistance) within prescribed tolerances. Thus for example, during the contacting process, the resistance or another electrical variable of the coil can be monitored electronically, a signal being given for completion of the welding or soldering process when a desired value is reached.

Both the position of the start winding 13 along the axis A on the central coil portion 11 and the position of the end winding 18 in the axial direction on the main winding 16 can be chosen freely so that this position can comply with the constructional boundary conditions of the subsequent application of the coil, for example the position of the electrical supply lines at the subsequent mounting location of the coil being crucial for this.

The number of turns of the start winding 14 and of the end winding 18 is calculated such that the electrical efficiency both of the start winding 14 and of the end winding 18 is only within prescribed tolerances so that the start winding 14 and the end winding 18 are unimportant with respect to the total electrical properties of the coil. The electrical properties of the coil are hence determined virtually exclusively by the main winding 16.

The invention is not restricted to the above embodiment which serves merely for general explanation of the core concept of the invention. Within the scope of the patent, the device according to the invention can rather assume also embodiments other than those described above. The device can hereby have in particular features which represent a combination of the respective individual features of the claims.

Reference numbers in the claims, in the description and in the drawings serve merely for better comprehension of the invention and are not intended to restrict the scope of the patent.

The invention claimed is:

1. An electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm.

2. The electric coil according to claim 1, wherein the coil core is provided at least in the region of the main winding with an insulating layer which is applied preferably on the coil core, and wherein at least the main winding, preferably also the start winding, is wound onto the insulating layer.

3. The electric coil according to claim 2, wherein the insulating layer concerns a coating made of a polymeric coating material and is applied preferably by means of gas phase deposition on the coil core.

4. The electric coil according to claim 1, wherein the end winding surrounds a portion of the main winding.

5. The electric coil according to claim 4, wherein the respective number of turns of the coil wire of the start winding and of the end winding is calculated such that the respective electrical efficiency of the start winding and of the end winding is within prescribed tolerances after completion of the contacting with respective electrical supply lines.

6. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the end winding surrounds a portion of the main winding, and wherein the respective number of turns of the coil wire of the start winding and of the end winding is calculated such that the respective electrical efficiency of the start winding and of the end winding is within prescribed tolerances after completion of the contacting with respective electrical supply lines, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner.

7. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the end winding surrounds a portion of the main winding, wherein the respective number of turns of the coil wire of the start winding and of the end winding is calculated such that the respective electrical efficiency of the start winding and of the end winding is within prescribed tolerances after completion of the contacting with respective electrical supply lines, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner, and wherein the contacts of the electrical supply line have respectively one recess in an attachment region, firstly the attachment region being placed, during production of the connection, on the winding to be contacted such that the recess contacts the winding, and subsequently a laser beam being directed towards the attachment region in the region of the recess.

8. The method for contacting a coil according to claim 7, wherein the recess is groove-shaped and preferably has a substantially V- or U-shaped profile.

9. The method for contacting a coil according to claim 7, wherein the attachment region is coated with a solder in the region of its recess on the outside thereof which points in the direction of the coil.

10. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the end winding surrounds a portion of the main winding, wherein the respective number of turns of the coil wire of the start winding and of the end winding is calculated such that the respective electrical efficiency of the start winding and of the end winding is within prescribed tolerances after completion of the contacting with respective electrical supply lines, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively a plurality of turns of the start- or of the end winding being connected to the respective contacts of the electrical supply line in an electrically conductive manner, and, wherein the first contact of the electrical supply line, which is to be connected to the start winding, is connected to at least one turn situated under the external turns of the start winding in an electrically conductive manner.

11. The method according to claim 10, wherein the second contact of the electrical supply line, which is to be connected to the end winding, is connected to at least one turn situated under the external turns of the end winding in an electrically conductive manner.

12. The method for contacting a coil according to claim 11, wherein the number of turns connected to the respective contact in an electrically conductive manner is chosen such that the electrical properties of the entire coil are within prescribed tolerances.

13. An electric coil device comprising (a) an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm; and (b) an electrical supply line having two contacts, wherein a first contact is connected to the start winding of the coil in an electrically conductive manner, and a second contact is connected to the end winding of the coil in an electrically conductive manner, both contacts respectively having a preferably groove-shaped recess in an attachment region, the lowest point of which recess, viewed in cross-section, sits respectively between the external turns of the start- or end winding.

14. The electric coil according to claim 2, wherein the end winding surrounds a portion of the main winding.

15. The electric coil according to claim 3, wherein the end winding surrounds a portion of the main winding.

16. The electric coil according to claim 1, wherein the respective number of turns of the coil wire of the start winding and of the end winding is calculated such that the respective electrical efficiency of the start winding and of the end winding s within prescribed tolerances after completion of the contacting with respective electrical supply lines.

17. The electric coil according to claim 2, wherein the respective number of turns of the coil wire of the start winding and of the end winding is calculated such that the respective electrical efficiency of the start winding and of the end winding is within prescribed tolerances after completion of the contacting with respective electrical supply lines.

18. The electric coil according to claim 3, wherein the respective number of turns of the coil wire of the start winding and of the end winding is calculated such that the respective electrical efficiency of the start winding and of the end winding is within prescribed tolerances after completion of the contacting with respective electrical supply lines.

19. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner.

20. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the coil core is provided at least in the region of the main winding with an insulating layer which is applied preferably on the coil core, and wherein at least the main winding, preferably also the start winding, is wound onto the insulating layer, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner.

21. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the coil core is provided at least in the region of the main winding with an insulating layer which is applied preferably on the coil core, and wherein at least the main winding, preferably also the start winding, is wound onto the insulating layer, wherein the insulating layer concerns a coating made of a polymeric coating material and is applied preferably by means of gas phase deposition on the coil core, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner.

22. The method for contacting an electric coil having (i) a coil core;

(ii) a main winding which surrounds the coil core and has an electrically conductive coil wire;

(iii) a start winding which surrounds the coil core and has an electrically conductive coil wire which is meant to be connected with a first contact; and (iv) an end winding which surrounds the coil core and has an electrically conductive coil wire which is meant to be connected with a second contact, wherein the coil wire of the main winding, the coil wire of the start winding and the coil wire of the end winding are formed by a continuous winding wire and at least the main winding, preferably also the start winding, is wound directly onto the coil core, whereby the coil wire has a diameter of at most 50 μm, wherein the end winding surrounds a portion of the main winding, the method comprising the steps of:

(a) connecting a first contact of an electrical supply line to at least one external turn of the start winding in an electrically conductive manner; and (b) connecting a second contact of an electrical supply line to at least one external turn of the end winding in an electrically conductive manner, wherein the connection is produced by welding or soldering, preferably using a laser beam, respectively, a plurality of turns of the start- or of the end winding being connected to the respective contacts of the electrical supply line in an electrically conductive manner.

23. The method for contacting a coil according to claim 8, wherein the attachment region is coated with a solder in the region of its recess on the outside thereof which points in the direction of the coil.

* * * * *